US005327607A

United States Patent [19]

Wagner

[11] Patent Number: 5,327,607

[45] Date of Patent: Jul. 12, 1994

[54] TOOTHBRUSH FOR CLEANING MULTIPLE SIDES OF TEETH

[76] Inventor: Eugene C. Wagner, c/o Dental Concepts, 9 North, Elmsford, N.Y. 10523

[21] Appl. No.: 8,562

[22] Filed: Jan. 22, 1993

Related U.S. Application Data

[63] Continuation-in-part of Ser. No. 890,790, Jun. 1, 1992.

[51] Int. Cl.[5] ..... A46B 9/04

[52] U.S. Cl. ..... 15/167.2

[58] Field of Search ..... 15/167.1, 167.2, 110, 15/171, 176.1, 172, 203; D4/104, 105, 106

[56] References Cited

U.S. PATENT DOCUMENTS

| | | | |
|---|---|---|---|
| D. 98,041 | 12/1935 | Rudof | D4/25 |
| D. 98,042 | 12/1935 | Rudof | D4/25 |
| D. 259,977 | 7/1981 | Porper | D4/25 |
| D. 273,153 | 3/1974 | Wagner | D4/28 |
| D. 289,230 | 4/1987 | Martino | D4/110 |
| D. 315,450 | 3/1991 | Wagner | D4/106 |
| 2,528,992 | 9/1946 | Barr | 15/167.2 |
| 2,588,601 | 3/1952 | Zavagno | 15/167.2 |
| 2,771,624 | 11/1956 | Ripper | 15/167.2 |
| 4,131,967 | 1/1979 | Northemann et al. | 15/167.2 |
| 4,137,593 | 2/1979 | Porper | 15/167.1 |
| 4,366,592 | 1/1983 | Bromboz | 15/221.2 |
| 4,382,309 | 5/1983 | Collis | 15/167.2 |
| 4,449,266 | 5/1984 | Northemann et al. | 15/167.2 |
| 4,619,485 | 10/1986 | Lewis, Jr. | 300/21 |
| 4,635,313 | 1/1987 | Fassler et al. | 15/193 |
| 4,637,660 | 1/1987 | Weihrauch | 300/21 |
| 4,638,520 | 1/1987 | Eickmann | 15/22 R |
| 4,646,381 | 3/1987 | Weihrauch | 15/167.1 |
| 4,757,570 | 7/1988 | Haeusser et al. | 15/167.2 |
| 4,776,055 | 10/1988 | Nelson | 15/167.1 |
| 5,046,213 | 9/1991 | Curtis et al. | 15/207.2 |

FOREIGN PATENT DOCUMENTS

| | | | |
|---|---|---|---|
| 0483939 | 4/1938 | Australia | 15/167.2 |
| 0212559 | 5/1957 | Australia | 15/167.2 |
| 2618651 | 2/1989 | France | 15/167.2 |
| 2641680 | 7/1990 | France | 15/167.2 |
| 0594027 | 5/1959 | Italy | 15/167.2 |
| 0179403 | 11/1935 | Switzerland | 15/167.2 |
| 9006701 | 6/1990 | World Int. Prop. O. | 15/167.2 |

*Primary Examiner*—Harvey C. Hornsby
*Assistant Examiner*—Gary K. Graham
*Attorney, Agent, or Firm*—Natter & Natter

[57] ABSTRACT

An ansate oral prophylaxis device includes a hand engageable shaft having a bristle carrying head at one end. The head is configured for oral anti-carries and periodontal prophylaxis with simultaneous bristle contact against all accessible tooth and adjacent gingival surfaces on each reciprocal stroke. The head is configured with a spine and pair of generally planar side panels, each lying in a plane approximately 45° from the plane of the spine. Bristles project perpendicularly from the spine for engagement against occlusal tooth surfaces, while bristles project perpendicularly from the side panels for engagement against buccal and lingual tooth side walls, gingival surfaces and tooth surfaces beneath the gum line. To assure softer bristle contact with gingival surfaces, the bristles of the side panels are progressively tapered in length with the longest bristles being furthest from the spine and the shortest bristles being adjacent the spine. The planes of the side panel bristle ends intersect at approximately 30°.

16 Claims, 3 Drawing Sheets

FIG. 4
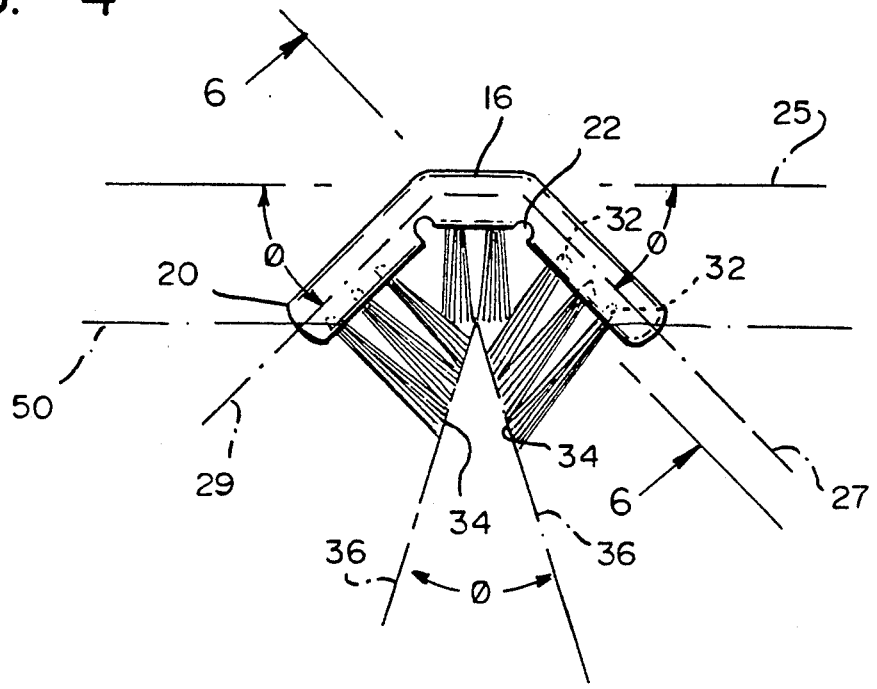
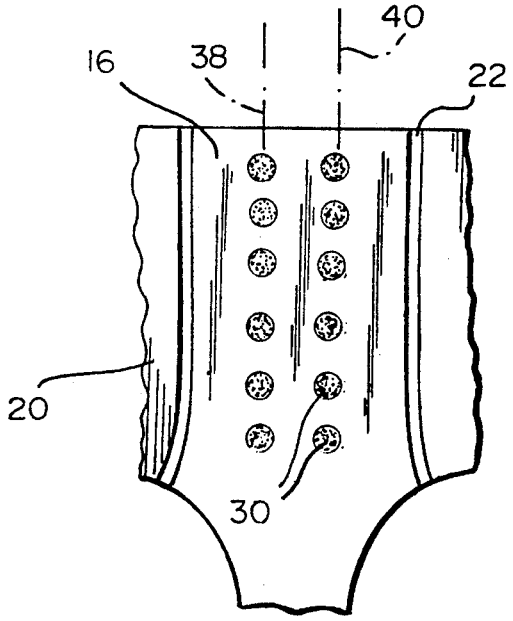
FIG. 5
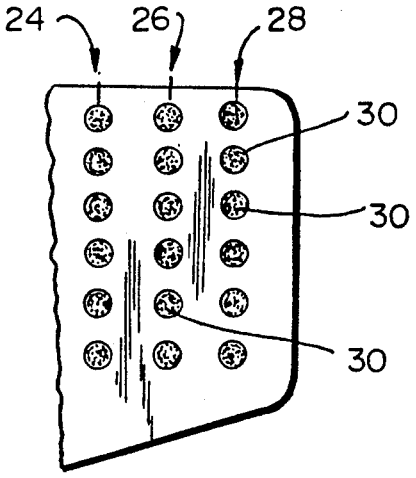
FIG. 6

FIG. 7
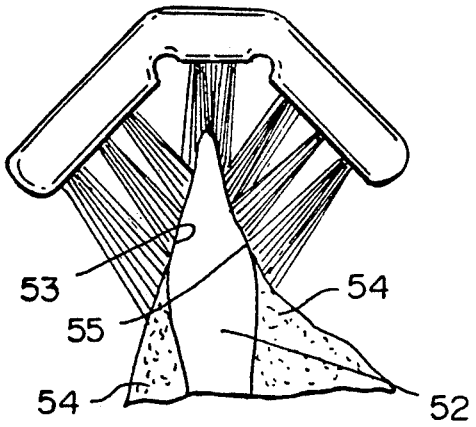
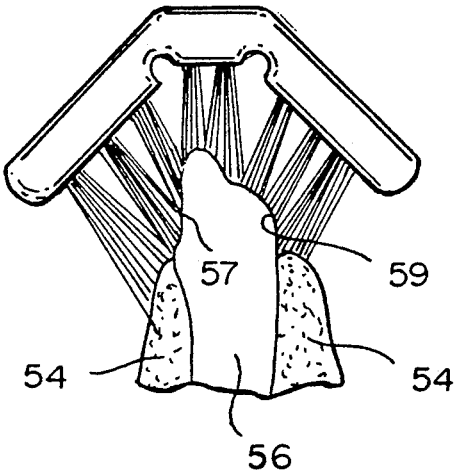
FIG. 8
FIG. 9
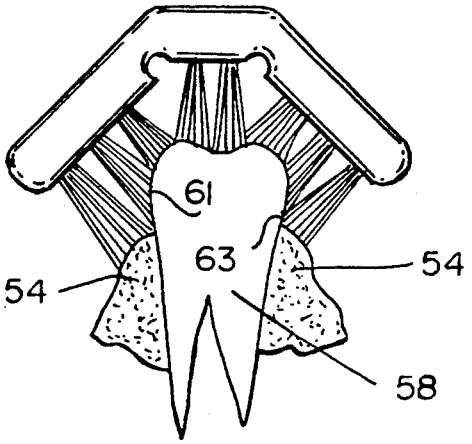

TOOTHBRUSH FOR CLEANING MULTIPLE SIDES OF TEETH

RELATED APPLICATIONS

This application is a continuation-in-part of application Ser. No. 07/890,790 filed Jun. 1, 1992.

BACKGROUND OF THE INVENTION

1. Field of the Invention

This invention relates generally to oral prophylactic and more particularly to a brush configured for simultaneous bristle engagement with occlusal, buccal and lingual tooth surfaces as well as adjacent gingival tissue.

2. Related History

The prior patents of the Applicant herein, patent Des. 273,153 issued Mar. 27, 1984 and patent Des. 315,450, issued Mar. 19, 1991 disclosed oral prophylactic configured with bristles for simultaneous engagement with occlusal, buccal and lingual tooth surfaces. Both of the aforementioned patents illustrated a toothbrush having a spine with bristles for contacting occlusal tooth surfaces and a pair of opposed side panels, each of which included bristles arrayed substantially along parallel axes which were also perpendicular to the axis of the spine.

Such arrangement assured simultaneous bristle contact with occlusal, buccal and lingual tooth surfaces, provided the brush head size, bristle length and gap between the opposed side panel bristle ends were anatomically configured to conform with the oral cavity and tooth dimensions of the intended user.

Brushes of the configuration shown in patent Des. 315,450 have been anatomically dimensioned for and commercialized in conjunction with the market comprising young children. Among the factors which influenced consumer acceptance were parental concerns that their children were not properly brushing. Such brush configuration assured thorough cleansing with the parent or child only required to employ a simple reciprocal stroke without twisting or rotating the brush.

It has been found, particularly with respect to adults, that improper brushing techniques lead to various maladies, not only relating to tooth structure, e.g. tooth decay, but, also periodontal diseases. Further, it was difficult to assure beneficial bristle contact against gingival tissue with the bristle configurations shown in patents Des. 315,450 and Des. 273,153.

When bristles of uniform length were utilized in toothbrushes configured for simultaneous engagement with multiple tooth and gingival surfaces, the stiffness of bristles contacting gingival tissue often resulted in trauma and concomitant bleeding. When soft bristles were employed, the requisite stiffness for tooth surface cleansing was not attainable.

It has been proposed in patent Des. 289,230 to employ bristles of different lengths in a single multi-sided brush, such construction required costly and difficult angular mounting of bristle bundles and commercial manufacture of such brush was apparently impractical. Other approaches required an awkward axial rotative manipulation in order to cleanse teeth such as exemplified by the toothbrush disclosed in U.S. Pat. No. 4,131,967 which comprised a brush head having two opposed sides projecting from a yoke.

SUMMARY OF THE INVENTION

An oral prophylactic in the configuration of an improved toothbrush includes a handle having a bristle carrying head at one end. The head includes a generally planar spine from which a plurality of rows of bristle bundles project in a direction transverse to the axis of the handle. A side panel is joined to each longitudinal edge of the spine with each panel carrying a plurality of rows of bristle bundles. Each bundle projects perpendicular to the plane of its panel and the planes of each panel are substantially perpendicular to one another.

The bristles of the rows of the side panels which are most distant from the spine are of longer length than the bristles of the rows closest to the spine with the bristles of the rows being progressively tapered in length so that the ends of the bristles of the side panels lie substantially within a single plane.

The planes of the side panel bristle ends intersect at an acute angle with the line of intersection being parallel to the axis of the handle and lying substantially within a plane of the spine bristle ends.

Such bristle configuration assures simultaneous bristle contact with occlusal fossa as well as buccal and lingual tooth side walls and gingival tissue with the longest length bristles engaging gingival tissue.

From the foregoing compendium, it will be appreciated that it is an aspect of the present invention to provide an ansate oral prophylactic of the general character described which is not subject to the disadvantages of the related history aforementioned.

It is another aspect of the present invention to provide an ansate oral prophylactic of the general character described which assures simultaneous tooth cleansing and gingival tissue engagement with but a simple reciprocal back and forth stroke.

A consideration of the present invention to provide an ansate oral prophylactic of the general character described which is suitable for economical mass production fabrication.

To provide an ansate oral prophylactic of the general character described which is relatively low in cost is a feature of the present invention.

A further aspect of the present invention is to provide an ansate oral prophylactic of the general character described which is suitable for efficaciously cleansing incisor, cuspid, bicuspid, molar and wisdom tooth surfaces without requiring twisting or rotative manipulation.

Another consideration of the present invention to provide an ansate oral prophylactic of the general character described which utilizes bristles of uniform composition yet provides reduced stiffness for bristles in contact with gingival tissue.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

FIG. 4 is an enlarged scale end view of the head and illustrating the rows of bristle bundles projecting from the side panels and from the spine;

FIG. 5 is an enlarged scale fragmentary bottom view of the spine, similar to the view of FIG. 3, with the side panels being deleted for clarity;

FIG. 6 is an enlarged scale fragmentary sectional view through the bristles of one side panel, the same being taken substantially along the line 6—6 of FIG. 4;

FIG. 7 is an enlarged scale end view of the ansate oral prophylactics head in an oral cavity showing bristles in engagement with a central incisor and surrounding gingival tissue;

FIG. 8 is an end view of the head in an oral cavity, similar to that of FIG. 7, showing bristles in engagement with a bicuspid and surrounding gingival tissue; and FIG. 9 is an enlarged scale end view of the head in an oral cavity showing bristles in engagement with a molar and surrounding gingival tissue.

DESCRIPTION OF THE PREFERRED EMBODIMENT

Figure 1:
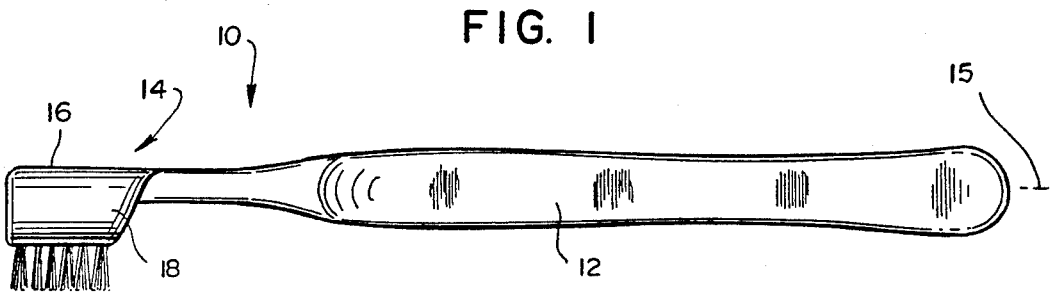
FIG. 1 is a side elevational view of an ansate oral prophylactic constructed in accordance with and embodying the invention in the form of a toothbrush and illustrating a bristle carrying head at one end of a handle.
Figure 2:
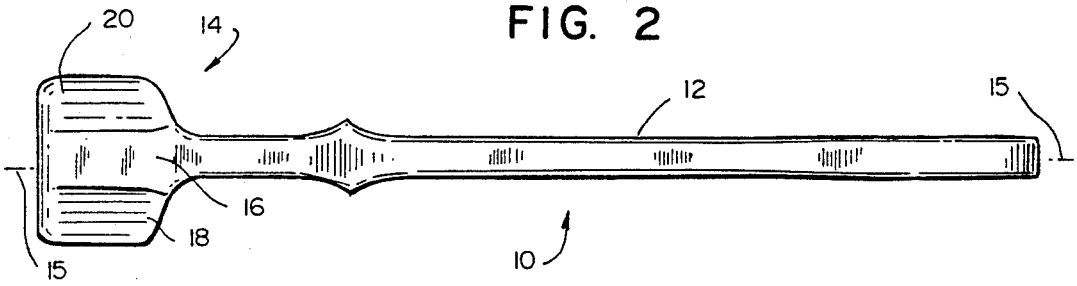
FIG. 2 is a top plan view of the ansate oral prophylactics.

Referring now in detail to the drawings, the reference numeral 10 denotes generally an ansate oral prophylactic in the form of a toothbrush constructed in accordance with and embodying the present invention. The prophylactic includes an elongate handle 12 having, adjacent one end thereof, an enlarged head 14. The handle extends along a longitudinal axis, denoted by the reference numeral 15.

Figure 3:
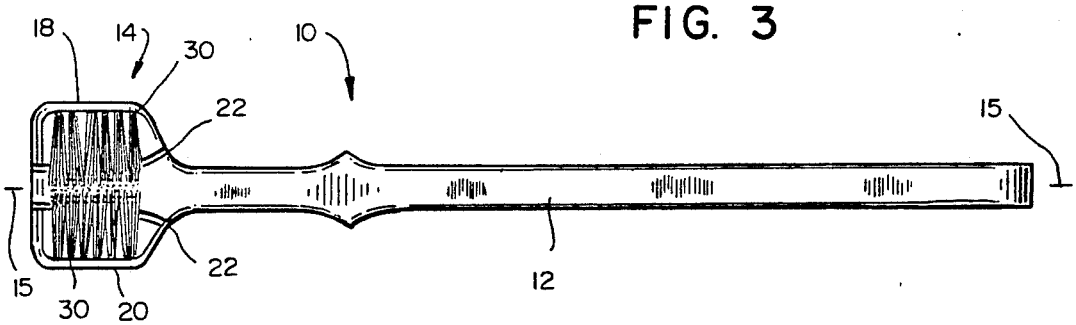
FIG. 3 is a bottom view thereof and showing rows of bristle bundles extending from a pair of opposed head side panels and the ends of bristles projecting from a spine portion of the head.

As will be observed from an examination of FIGS. 3 and 4, the head 14 includes a generally planar spine 16 and a pair of side panels 18, 20, respectively. The side panels 18, 20 are connected to the spine 14 along the longitudinal edges of the spine at a concave groove channel 22 which functions as a fold line during assembly only. As will be explained in greater detail hereinafter, the fold lines 22 provide a weakened area for bending the head into the appropriate configuration during fabrication of the prophylactic 10.

Each panel 18, 20 includes a plurality of substantially parallel rows 24, 26, and 28 of bristle sheafs or bundles 30 with each row of bundles 30 extending along a longitudinal axis which is substantially parallel to the axis 15. The bristles of each bundle are of substantially uniform length and with each bristle terminating at a free end 34.

Hollow sockets 32 are formed in the side panels 18, 20 and each bundle 30 is anchored in a socket 32 in a manner which is conventional and known to those of skill in the art. Alternately, the bristle bundles 30 may be positioned in a mold with the entire bristle head being molded around the end portions of the bristle bundles.

As is illustrated in FIG. 4, a plane 27, 29 passes through the side panels 18, 20 respectively and the side panels 18, 20 are inclined, with respect to a plane 25 through which the spine passes an angle $\theta$. Preferably, the angle $\theta$ is in the order of 45°, hence the planes 27, 29 through which the side panels 18, 20, pass, are substantially perpendicular to one another.

In accordance with the present invention, the ends 34 of the side panel bristles of the row 28 most distant from the spine 16 are longer than the bristles in the row 24, which extends along the axis 24, adjacent the spine 16. The ends of the bristles in the intermediate row 26, are of a length intermediate the lengths of the bristles in the rows 24, 28 such that the bristles of each row, 28, 26, 24 of each side panel 18, 20 are progressively tapered in length and lie substantially within a single plane, denoted generally by the reference numeral 36. The angle of intersection of the two planes 36 is an acute angle, $\phi$ preferably in the order of 30°.

With reference now to FIG. 5, it will be noted that the spine 16 includes a plurality of rows 38, 40 of bristle bundles, with all bristle bundle rows 24, 26, 28, 38 and 40 being parallel to and substantially parallel to one another and the axis 15 of the handle 12. The ends 34 of the bristles in the rows extending along the axes 38, 40 of the spine 16 lie substantially in a single plane 50 which is parallel to the spine plane 25 and within which the line of intersection of the planes 36 lies.

It should be understood that when reference is made to the planes 36, 50 within which the ends of the bristles lie, alternate bristle bundle configurations, e.g. feathered rather than straight cut ends, should be considered to be encompassed within such terminology and to lie substantially within a single plane.

Such bristle arrangement assures thorough cleansing of all tooth surfaces within an oral cavity including occlusal fossa as well as buccal and lingual tooth side walls, as will be more clearly illustrated from an examination of FIGS. 7, 8 and 9.

In FIG. 8, the head 14 of the oral prophylactic is shown with its bristle bundles 30 in engagement with a central incisor 52. It should be noted that the spine bristles in the rows 38, 40, engage occlusal surfaces of the incisor 52 and adjacent buccal and lingual surfaces 53, 55. The bristles of the side panel rows 24, i.e. the shortest and stiffest bristles, engage upper portions of the buccal and lingual side walls 53, 55. The intermediate length bristles of the rows 26 engage medial surfaces of the buccal and lingual side walls 53, 55, while the longest, i.e. most flexible bristles of the rows 28 simultaneously engage lower buccal and lingual side wall surfaces 53, 55 as well as adjacent gingival tissue 54.

With reference now to FIG. 8 wherein the bristles of the head 14 are shown in engagement with a bicuspid 56, it will be noted that the bristles of the spine rows 38, 40 are in engagement with occlusal surfaces including fossa; the shortest length side panel bristles extending along the rows 24 may be in partial engagement with occlusal surfaces and are in engagement with buccal and lingual side walls 57, 59. The intermediate length bristles of the rows 26 are also in engagement with the buccal and lingual side walls 57, 59 and the longest bristles of the rows 28 are in simultaneous engagement with lower buccal and lingual side walls 57, 59 as well as the adjacent gingival tissue 54.

With reference now to FIG. 9 wherein the bristles of the head 14 are shown in engagement with a molar 58, it will be observed that bristles of the spine rows 38, 40 are in engagement with the occlusal surfaces including fossa. The shortest side panel bristles extending along the rows 24 are also in engagement with occlusal surfaces and a portion of buccal and lingual side walls 61, 63; the bristles of the intermediate length side panel rows 26 are in engagement with the buccal and lingual side walls 61, 63 and the longest bristles of the rows 28 are in simultaneous engagement with the lower buccal and lingual side walls and the adjacent gingival tissue 54.

With a reciprocal back and forth stroke, the bristles of the side panel rows 24, 26, 28 will reach all accessible tooth surfaces on the side walls, including interdental surfaces due to the natural flex of the bristles. Further tooth surfaces beneath the gum line are also engaged by the bristles of the rows 28.

Thus, it is evident that with a simple nonrotational axial back and forth stroke, the prophylactic is capable of thorough cleansing of accessible tooth surfaces of all teeth, including interdental surfaces and also provides appropriate gingival tissue stimulation without trauma.

The ansate oral prophylactic 10 is injection molded of a suitable thermoplastic with the bristles of the bristle bundles being preferably formed of a suitable polyamide monofilament such as Nylon 612. Each bristle may be of a diameter in the order of 0.16 mm and approximately 28 bristles may be utilized for each bristle bundle 30 with the bristle bundles having a diameter at the area of the sockets 32 in the order of 1.5 mm.

The rows of bristle bundles 30 may be approximately 14 mm in length and the combined width of the three side panel rows 24, 26, 28 may be approximately 6 mm while the combined width of the spine rows 38, 40 is approximately 4 mm.

The projecting length, i.e. distance from the bristle ends 34 to the side panel, of the bristles in the row 28 is approximately 9 mm, while the projecting lengths of the bristles of the rows 26, 24 are approximately 8 mm and 7 mm, respectively. The bristles of the spine rows 38, 40 are approximately 6 mm in length.

Preferably, the prophylactic is formed in a two or three stage operation. If a three stage operation is utilized, the handle and head are injection molded in one piece with the side panels and the spine lying substantially within a single plane, i.e. the plane 25 of the spine. The head is molded with all of the bristle bundle sockets being oriented along axes perpendicular to the plane 25. Thereafter, the bristle bundles 30 are inserted into their respective sockets 32 and project therefrom in a direction perpendicular to the plane 25.

If the lengths of the bristles of the side panel bristle bundles are precut, the final stage in fabrication is the heating of the head and the bending of the side panels along the respective groove fold lines 22.

If, on the other hand, the lengths of the bristle bundles are uniform at the time the bristle bundles are inserted, the bristle ends must be cut. This may take place prior to or after bending the side panels relative to the spine.

In the event the bristle bundles are molded in place rather than separately inserted into the sockets 32, after ejecting the molded toothbrushes from the die, the side panel bristle ends are cut to appropriate length and the side panels are bent along the groove fold lines 22. Alternately, the ends of the side panel bristles may be cut to length after the side panels have been bent into place or precut bristles may be molded in place and only the bending operation need be performed.

Thus, it will be seen that there is provided an ansate oral prophylactic which achieves the various aspects, features and considerations of the present invention and which is well adapted to meet the conditions of practical usage.

Since various possible embodiments might be made of the present invention and since various changes might be made in the exemplary embodiment shown without departing from the spirit of the invention, it is to be understood that all matter herein described or shown in the accompanying drawings is to be interpreted as illustrative and not in a limiting sense.

Having thus described the invention there is claimed as new and desired to be secured by Letters Patent:

1. An ansate oral prophylactic comprising an elongate handle and an enlarged head, the head being positioned at one end of the handle, the handle and the head being unitarily formed of one piece construction, the head including an elongated spine, the spine having at least one row of bristles projecting therefrom, said at least one row extending in a direction generally along the length of the spine, the spine having a pair of sides extending along the length of the spine, the head having a pair of side panels, each side panel being connected to the spine along a respective side of the spine, each side panel lying within a plane, each side panel including a plurality of rows of bristles, each row of side panel bristles extending in a direction substantially parallel to the direction of said at least one row of spine bristles, the bristles of each side panel row extending substantially perpendicular to the plane within which the respective side panel lies, all of the bristles of each respective side panel having ends which lie substantially within a single plane, the side panel bristle end planes intersecting one another at an acute angle, the ends of the at least one row of spine bristles lying substantially within a single plane, the side panel bristle end planes intersecting one another at the plane of the at least one row of spine bristle ends and the planes within which the respective side panels lie intersecting one another at an angle greater than the angle of intersection of the side panel bristle end planes, such that efficacious cleansing of all accessible tooth surfaces is attainable with a simple back and forth stroke.

2. An ansate oral prophylactic as constructed in accordance with claim 1 wherein the planes of the side panels are perpendicular to one another.

3. An ansate oral prophylactic as constructed in accordance with claim 1 wherein the bristles of each row of side panel bristles are substantially uniform in length.

4. An ansate oral prophylactic as constructed in accordance with claim 1 wherein the spine includes at least two rows of bristles and each side panel includes at least three rows of bristles.

5. An ansate oral prophylactic as constructed in accordance with claim 1 wherein each row of bristles is in the order of 14 mm in length.

6. An ansate oral prophylactic as constructed in accordance with claim 1 wherein the angle of intersection of the side panel bristle end planes is in the order of 30°.

7. An ansate oral prophylactic as constructed in accordance with claim 1 wherein the length of the side panel bristles of the row most distant from the spine is greater than the length of the bristles of the row closest to the spine.

8. An ansate oral prophylactic as constructed in accordance with claim 7 wherein the length of the side panel bristles of the row most distant from the spine is in the order of 9 mm.

9. An ansate oral prophylactic as constructed in accordance with claim 8 wherein the length of the bristles of the row closest to the spine is in the order of 7 mm.

10. An ansate oral prophylactic as constructed in accordance with claim 9 wherein three rows of side panel bristles are provided, the length of the bristles of the row between the row most distant from the spine and the row closest to the spine being in the order of 8 mm.

11. An ansate oral prophylactic as constructed in accordance with claim 1 wherein a pair of grooved channels are provided in the head, the groove channels defining the longitudinal edges of the spine, the thickness of the head being reduced at the groove channels, whereby bending of the side panels relative to the spine during fabrication is facilitated.

12. An ansate oral prophylactic as constructed in accordance with claim 1 wherein the bristles of each row are arrayed in bundles.

13. An ansate oral prophylactic as constructed in accordance with claim 12 wherein each bristle bundle is comprised of a plurality of bristles, each bristle having a diameter in the order of 0.16 mm.

14. An ansate oral prophylactic as constructed in accordance with claim 13 wherein each bristle bundle is comprised of approximately 30 bristles.

15. An ansate oral prophylactic, the prophylactic comprising an elongated handle and a head attached thereto, the handle and head having a generally vertical plane passing therethrough, the head including means for supporting a group of bristles oriented for engagement with tooth surfaces, the group of bristles including a first plurality of bristles oriented and extending from the head at an angle in the order of 45° to the generally vertical plane and adapted for engagement with lingual tooth side wall surfaces, the group further including a second plurality of bristles oriented and extending from the head at an angle in the order of 45° to the generally vertical plane and adapted for engagement with buccal tooth side wall surfaces, the group further including a third plurality of bristles oriented and extending from the head substantially vertically and adapted for engagement with occlusal tooth surfaces, the ends of the bristles of the first plurality lying substantially in a single plane and the ends of all the bristles of the second plurality lying substantially in a single plane, the planes of the ends of the bristles of the first and second pluralities intersecting at an acute angle along a line, the ends of all the bristles of the third plurality lying substantially within a single plane, the plane of the ends of the bristles of the third plurality being coincident with the line of intersection of the planes of the ends of the bristles of the first and second pluralities.

16. An ansate oral prophylactic as constructed in accordance with claim 15 and each plurality of bristles are arrayed in rows, each row comprising a plurality of bristle bundles.

* * * * *